US008020351B2

(12) United States Patent
Stephens

(10) Patent No.: US 8,020,351 B2
(45) Date of Patent: Sep. 20, 2011

(54) FRAMEWORK AND METHOD FOR RETROFITTING A SMALL BASEMENT WINDOW WITH AN EGRESS WINDOW

(76) Inventor: Theodore G Stephens, Denver, CO (US)

( * ) Notice: Subject to any disclaimer, the term of this patent is extended or adjusted under 35 U.S.C. 154(b) by 215 days.

(21) Appl. No.: 12/465,816

(22) Filed: May 14, 2009

(65) Prior Publication Data

US 2010/0287855 A1 Nov. 18, 2010

(51) Int. Cl.
*E06B 1/00* (2006.01)

(52) U.S. Cl. ..... 52/217; 52/745.2; 52/204.56; 52/747.1

(58) Field of Classification Search ..... 52/68, 58, 52/60, 79.8, 204.1, 204.2, 205–215, 217, 52/633, 204.56, 204.62, 641, 645, 656.4, 52/656.5, 745.19, 745.05, 745.15, 745.2, 52/748.1

See application file for complete search history.

(56) References Cited

U.S. PATENT DOCUMENTS

| | | | | | |
|---|---|---|---|---|---|
| 618,145 | A | | 1/1899 | Tremmel | |
| 2,002,007 | A | * | 5/1935 | Hanson | 219/97 |
| 2,199,590 | A | | 11/1937 | Groth | |
| 2,380,834 | A | * | 7/1945 | Goldman | 52/742.12 |
| 2,530,102 | A | * | 11/1950 | Von Bampus | 249/27 |
| 2,658,252 | A | * | 11/1953 | Avril | 249/16 |
| 2,770,335 | A | | 11/1956 | Sylvan | |
| 3,008,550 | A | * | 11/1961 | Miles et al. | 52/210 |
| 3,284,912 | A | * | 11/1966 | Hoven | 33/194 |
| 3,375,627 | A | | 4/1968 | Bursiek | |
| 3,501,194 | A | * | 3/1970 | Frank | 296/156 |
| 3,537,212 | A | | 11/1970 | Gilles | |
| 3,648,424 | A | | 3/1972 | Winyard | |
| 4,222,458 | A | | 9/1980 | Pratt | |
| 4,327,523 | A | | 5/1982 | Gravely | |
| 4,392,330 | A | | 7/1983 | Buhr | |
| 4,430,831 | A | | 2/1984 | Kemp | |
| 4,555,867 | A | | 12/1985 | Stibolt | |
| 4,663,885 | A | | 5/1987 | Stibolt | |
| 4,986,044 | A | * | 1/1991 | Funari | 52/213 |
| 5,473,842 | A | | 12/1995 | Hillery | |
| 5,579,613 | A | * | 12/1996 | Carr | 52/79.1 |
| 5,832,666 | A | | 11/1998 | Flack | |
| 5,996,293 | A | | 12/1999 | Anderson | |
| 6,343,448 | B1 | | 2/2002 | Lin | |
| 6,389,763 | B1 | | 5/2002 | Clauss | |
| 6,453,620 | B1 | | 9/2002 | Williams | |
| 6,550,194 | B2 | | 4/2003 | Jackson | |
| 6,585,311 | B2 | | 7/2003 | Farrar | |
| 6,588,154 | B1 | | 7/2003 | Miller | |
| 6,904,727 | B2 | | 6/2005 | Edger | |
| 6,931,810 | B2 | | 8/2005 | Beaudoin | |

(Continued)

*Primary Examiner* — Jeanette E. Chapman

(74) *Attorney, Agent, or Firm* — Leyendecker and Lemire LLC; Kurt Leyendecker

(57) ABSTRACT

A structural frame typically comprised of steel metallic material that is utilized in retrofitting a small basement window in an older residence with an egress window is described that comprises pieces of linear L-channel that has been formed into a rectangular frame. The thickness of the channel is relatively thin permitting an installer to retrofit the smaller window with a larger one that is only marginally less wide without having to cut an opening within the foundation wall that is wider than the original window's steel buck. Excepting the bottom side of the original window's buck, it can be left in place during retrofit. Accordingly, a substantial portion of the foundation wall's load carrying capacity around the window opening is maintained during retrofit eliminating the need for additional reinforcement.

14 Claims, 12 Drawing Sheets

U.S. PATENT DOCUMENTS

2001/0027600 A1 10/2001 Hodek
2003/0110703 A1 6/2003 Kobrehel
2007/0044401 A1 3/2007 Bonshor
2007/0089373 A1 4/2007 Heady
2008/0110110 A1 5/2008 Burton
2008/0209823 A1 9/2008 Gernstein

* cited by examiner

FRAMEWORK AND METHOD FOR RETROFITTING A SMALL BASEMENT WINDOW WITH AN EGRESS WINDOW

FIELD OF THE INVENTION

The present invention pertains to the retrofit of a small basement window with a window capable of permitting a person egress from the basement.

BACKGROUND

Most if not all of building codes in the United States require that any bedroom located in a basement have a window that permits an occupant egress therethrough so that the person can safely exit the bedroom in the case of fire or other catastrophe. Basements in older homes typically have relatively small windows located near the top of a concrete or block foundation that are not sufficiently large to permit the necessary egress. Accordingly, to place a bedroom in such a basement, the owner must retrofit the structure by installing a larger egress capable window.

Traditionally, the process of removing a smaller window and retrofitting the basement with a larger window is both time-consuming and costly. For instance, to replace a standard 30.5"×20" window with a similarly wide but much longer (~47") egress window, a much wider opening (at least 3" or more) must be made in the foundation to account for the installation of wooden structural framework around the window to both support the window as well as provide a foundation load transfer path around the window.

When basement windows are installed in a cast concrete, a concrete block or a brick foundation during original construction, a steel window buck is typically cast or grouted in place. This buck acts to transfer the load around the window and maintain load transfer capability in the portion of the foundation wall in which the window resides.

When retrofitting the smaller window with longer one of similar width, the steel load carrying buck is removed effectively reducing or even eliminating the load carrying capacity of the associated portion of the foundation. In a continuous footer type foundation, the localized reduction in load carrying capacity is primarily confined to the particular portion of the foundation wall and depending on the span of opening will not be detrimental to the residential structure if the load carrying capability is restored shortly thereafter. However, concerning pier-type foundations wherein the foundation wall acts as a load carrying web to transfer load laterally between piers, the effect of effectively severing the load transfer when the buck is removed can cause immediate structural problems.

To mitigate any problems that might result from the removal of the steel window buck and because prior art retrofit wood framework does not carry or transfer load around a window very effectively, structural engineers will often require a retrofitter to install a header of steel L-channel to the sill of the foundation wall immediately above the location of the window that spans a sufficient distance on either side of the planned opening. One leg of the L-channel is placed flush against the top surface of the sill while the perpendicular other leg rests against the inside wall of the foundation. The plate is pined, bolted or otherwise secured to the foundation wall. Accordingly, when the opening is subsequently cut, any load that was carried by the wall and the original window's steel buck is transferred to and carried by the L-channel. If the associated interior basement wall is finished, demolition of the finished wall is typically required to install the L-channel greatly increasing the cost of the retrofit.

The L-channel is almost always left in place even after the egress window is installed. This permits the installer to use less stout framing for the window which is easier and less expensive to install. For instance, 2×4 dimensional studs can be used to provide the framework for the window.

There are several problems with posed with using an L-channel header. First, an L-channel header increases the cost and time required to install an egress window. Additionally, in many older basements the top surface of the foundation may be located only a few inches above the top of the window. Where an L-channel having 4" or longer legs is specified, the vertical leg of the channel may extend over the top of the opening. With a basement window the most and best light is transmitted into the space from the portions of the window proximate the top edge thereof as the light entering the space from the lower portions is usually not direct but reflected off of a window well. Accordingly, even a couple inches of L-channel overhang can significantly block the amount and quality of light entering an associated space. Finally, pinning or fastening the L-channel to the sill can be very difficult since locating the pins too close to the wall's edge (typically less than 4") can cause cracking and localized failure of the wall in this region. Accordingly, even large and wider L-channel may be required.

In other egress window retrofits where no L-channel is utilized, the framework surrounding the window must be more stoutly configured to carry the attendant loads. The framework is typically comprised of dimensional lumber or steel. In either instance, the cost associated with fabricating the frame on site and securing it to the foundation can be very expensive as well as time consuming. Where a wood frame is utilized the height of a header can necessitate the lowering of the new window's top edge.

Ultimately, using prior art materials and methods, retrofitting a small basement window with an egress capable window to facilitate providing an extra bedroom in a basement is both costly and time consuming adding significantly to the cost of finishing a basement. Further, if the retrofit is not properly done, damage to the foundation and ultimately the above grade structure of a residence can result.

DETAILED DESCRIPTION

Figure 1:
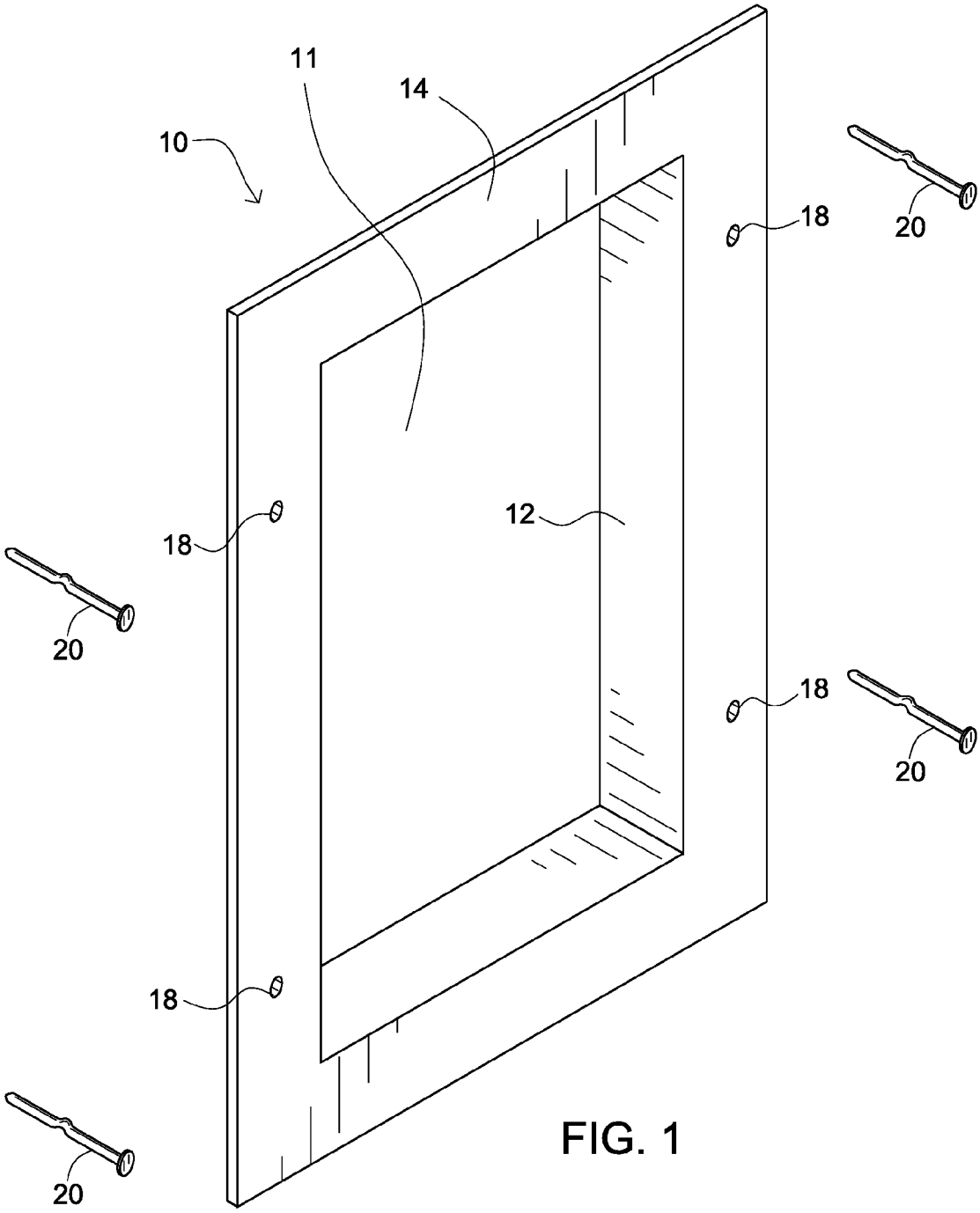
FIG. 1 is an isometric front view of a structural frame for use in retrofitting window in a basement wall according to one embodiment of the present invention.

One Embodiment of the present invention comprises a structural frame typically comprised of a metallic material that is utilized in retrofitting a small basement window in an older residence with an egress window. Another embodiment comprises the process of installing the egress window using the structural frame.

Embodiments of the structural frame comprise pieces of linear L-channel/angle iron that has been formed (typically welded) into a rectangular frame. The particular dimensions of the L-channel can vary pending upon structural requirements of a particular foundation. However, the thickness of the channel is relatively thin, typically about 0.25 inches. As assembled, the structural frame has an exterior flange portion and an insertion portion. On any one side of the rectangle, the exterior flange portion is substantially orthogonal to the insertion portion wherein each portion is substantially planar. Accordingly, the insertion portion is slid into the opening and interfaces against the inside services of the foundation wall opening, and exterior flange portion fits flush against the exterior surface of the basement wall effectively framing the opening.

The structural frame serves the purpose of providing the necessary framework for the egress window as well as providing a load transfer path around the window. Accordingly, additional framework or structural additions to the foundation wall are not typically required. The frame is typically prefabricated saving time and labor expense when compared to constructing a framework on site within an enlarged window opening as is required using prior art methodology. By situating using an exterior flange that extends outwardly of the opening and fits flush against the exterior surface of the foundation wall, the frame provides the inherent structural strength of an L-frame without hindering the transfer of light into the associated basement space.

The thinness of the insertion portion permits an installer to retrofit the smaller window with a larger one that is only marginally less wide without having to cut an opening within the foundation wall that is wider than the original window's steel buck. Accordingly, excepting the bottom side of the original window's buck it can be left in place during retrofit. By leaving the top and left and right sides of the original buck in place, a substantial portion of the foundation wall's load carrying capacity around the window opening is maintained during retrofit eliminating the need for additional reinforcement, such as an L-channel header that is expensive to install and can ultimately hinder the transmission of light into the basement space. Further, the added cost in terms of installer time for separating a cast in place or otherwise secured buck from the surrounding foundation wall is eliminated. Additionally, by leaving the buck in place, the strength of the foundation wall around the new window is increased relative to the structural frame alone or an onsite built framework as is common in the prior art.

To install an egress window in place of an existing small window once the surrounding area of the foundation has been excavated and the original window has been removed, an installer makes a horizontal cut through the foundation wall at the bottom of the desired opening. Next, He/she guides a ring saw or other suitable cutting implement through the intersection of the respective left and right sides of the buck with the buck's bottom side and downwardly until intersecting with the horizontal cut. Once both the left and right sides have been cut, the freed block of concrete or other foundation material is removed.

The structural frame is then slid in place until the sealant tape on the backside of the exterior flange portion is in contact with the exterior wall of the foundation. The installer then typically drills a series of holes into the foundation using pin fastener openings on the structural frame as guides. Concrete pins are placed through the frame and into the aligned foundation holes. The pins are typically set in place using a sledge hammer, which pulls the backside of the flange firmly and securely against the exterior surface of the foundation causing the sealant tape (also referred to as a sealant gasket) to form a weatherproof seal.

After the structural frame has been secured in place, an egress window is secured within the structural frame and finished on the inside using traditional means. An egress window having a width of only 0.5" or so less than that of the removed window can be fit into the frame; whereas, the length is typically much longer. A new larger window well is fit in place and the remaining excavated hole is filled. Of note, no exterior finish work is required to the exterior foundation wall as the structural frame itself provides a finished look; however, optionally, a finish coat of paint can be applied to the frame as desired to compliment the finish on the exterior of the building. In other variations, a finish coat can be applied prior to installation. Since several preferred embodiments are comprised of steel, the frames are typically painted with at least a primer prior to installation.

Terminology

The terms and phrases as indicated in quotes (" ") in this section are intended to have the meaning ascribed to them in this Terminology section applied to them throughout this document including the claims unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive rather the term is inclusive meaning: either or both.

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearances of the phrase "in one embodiment" in various places in the specification are not necessarily all meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

Directional and/or relationary terms such as, but not limited to, "left", "right", "nadir", "apex", "top", "bottom", "vertical", "horizontal", "back", "front" and "lateral" are relative to each other and are dependent on the specific orientation of an applicable element or article, and are used accordingly to aid in the description of the various embodiments and are not necessarily intended to be construed as limiting.

As applicable, the terms "about" and "generally" as used herein unless otherwise indicated mean a margin of +−20%. Also, as applicable, the term "substantially" as used herein unless otherwise indicated means a margin of +−10%. Concerning angular measurements, "about" or "generally" refer to +−10 degrees and "substantially" refers to +−5.0 degrees unless otherwise indicated. It is to be appreciated that not all uses of the above terms are quantifiable such that the referenced ranges can be applied.

The phrases "window buck" as referred to herein refers to any structural framework that is secured or installed in place during the construction of a foundation or building that provides an opening for a basement window to be fit therein. Typically, window bucks are made from steel although bucks made of other materials are contemplated. Typically, the window buck transfers foundation load around the window to ensure that the structural integrity of the foundation is maintained and isolate the window unit from structural loads.

The phrase "structural frame" as used herein refers to the prefabricated framework that is placed within the enlarged window opening to hold and structurally isolate an egress window from the loads on a foundation wall. The frame also acts to direct structural loads through it to maintain structural continuity of the portions of the foundation wall on either side of the window opening. The structural frame is typically comprised of steel L-channel in the exemplary embodiments, but other structural shapes and materials are contemplated. For instance, a composite material or an aluminum material can be used to fabricate a suitable structural frame in other embodiments.

The phrase "egress window" refers to a window that is of sufficient size to permit a person egress therefrom when the window is opened so that in a case of fire or other calamity within the residence, a person in the basement can easily evacuate the structure through the window. The minimum size and dimensions of a window may vary with local building codes to qualify as a window suitable for use in a basement bedroom. Most codes require an egress window to have a minimum opening size of 5.75 square feet and be at least 20" wide.

A Structural Frame According to One Embodiment

Figure 2:
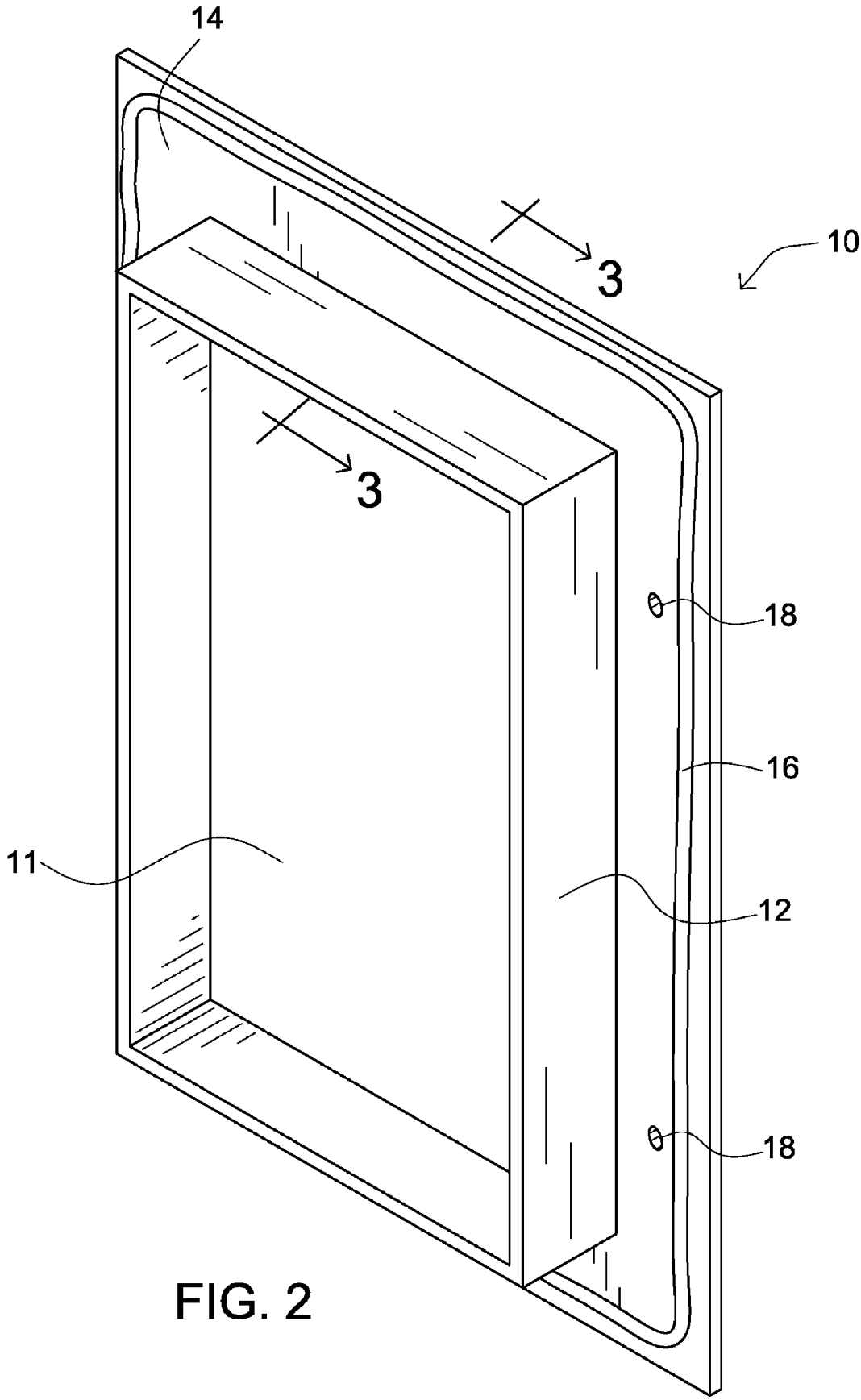
FIG. 2 is an isometric rear view of the structural frame of FIG. 1 according to one embodiment of the present invention.
Figure 3:
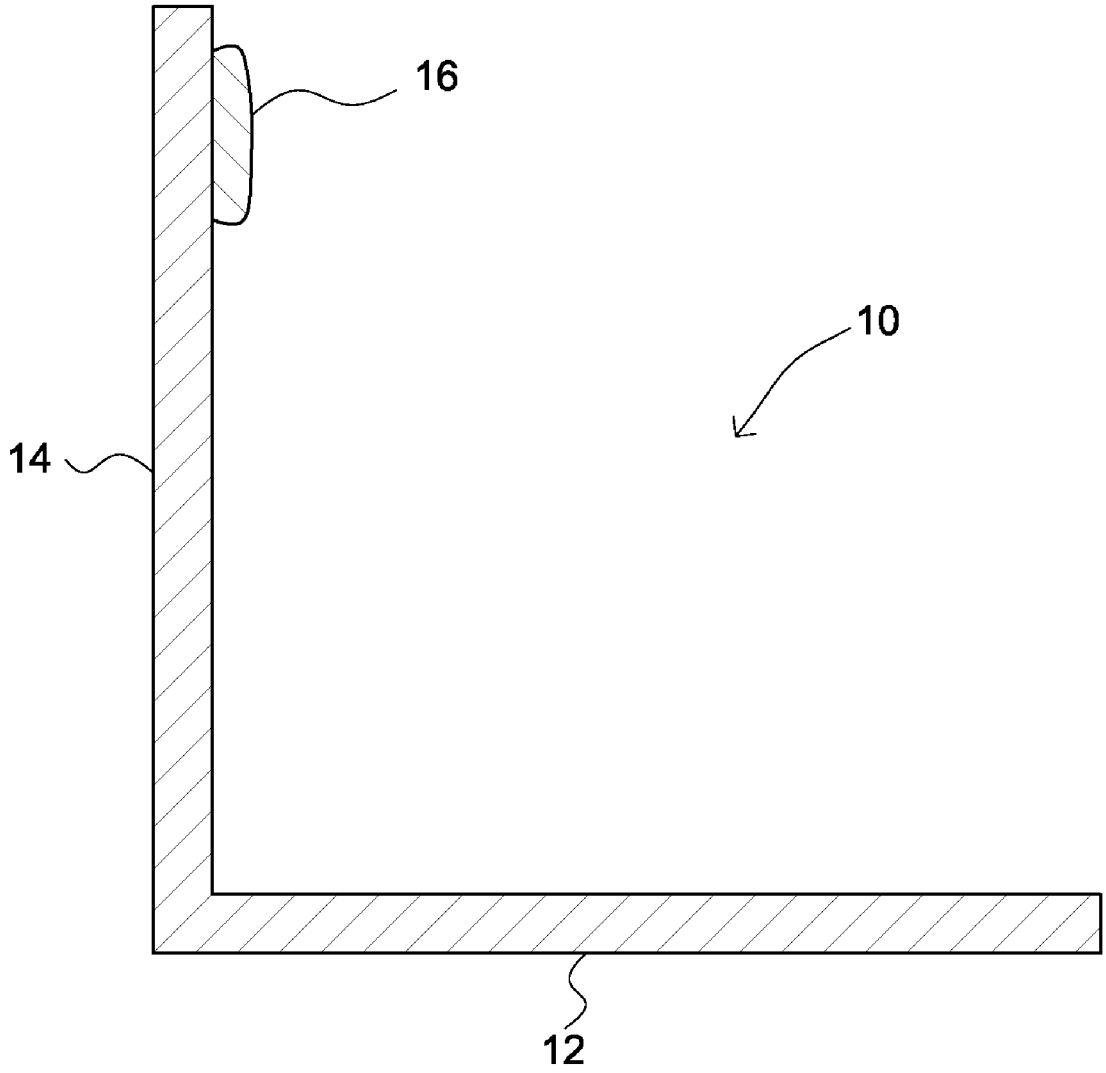
FIG. 3 is a cross section of the structural frame taken along line 3-3 of FIG. 2 according to one embodiment of the present invention.

An embodiment of a structural frame 10 is illustrated in FIGS. 1-3. The frame is generally rectangular in shape and defines a center open portion 11 wherein an egress window can be received. The frame is configured to isolate a window installed therein from loads and other forces that are transferred through or are incident on the foundation wall. The frame also acts to transfer such loading between adjacent sections of the foundation wall.

In the illustrated embodiment, the frame is comprised of pieces of linear steel L-channel, which can also be referred to as angle iron, that has been joined to form the rectangular shape. Typically, top, bottom, left and right pieces of L-channel are welded together to form respective top, bottom, left and right sides. The various pieces are typically welded but variations are contemplated that can be mechanically joined. Alternatively, the frame can even be cast or forged as a single piece. While steel has been found to be the most economical material to fabricate the frame, other materials can be used as well including but not limited to iron, aluminum alloys and structural composites.

The size of L-channel can vary depending on several factors such as the size of the center open portion 11, the type of foundation it is to be installed in, and the magnitude of the loads it is to withstand. However, for installations in a typical residential structure, steel L-channel having 4 inch wide first and second legs that are both about a quarter of an inch thick has been found to be suitable in most instances.

As shown, together the first leg of the L-channel of each of the top, bottom, left and right sides are configured to form a planar exterior flange portion 14 that has both a substantially planar front surface as can be seen in FIG. 1 and a substantially planar rear surface as can be seen in FIG. 2. Of note, variations are contemplated wherein the front surface need not be planar. Rather, it can be of any desired relief. The planar rear surface is desirable in that it permits the flange to mount flush against the planar exterior surface of the foundation wall surrounding a window opening cut therein.

A plurality of holes 18 are also typically provided that extend orthogonally through the flange portion 14. The holes are adapted to receive concrete pins 20, bolts or other mechanical fasteners therethrough to secure the structural frame to the foundation wall. The number and location of the holes can vary substantially depending on the type of foundation into which a structural frame is to be installed. For instance, four holes are provided when the structural frame is being installed in a footer-type foundation. However, additional holes are required when the frame is to be installed in piered type foundations wherein a greater amount a load is transferred through the frame.

The second leg of each side extends orthogonally rearwardly from an intersection with the inside edge of the first leg. The ends of each side's second leg orthogonally intersect with the ends of the second leg of an adjacent side. Together, the four second legs form an insertion portion 12 that interfaces with the inside edges of the foundation window opening. The flat interior surfaces of the insertion portion provide a mounting location for egress window of predetermined size. Because the structural frame is premade to specific dimensions relative to a specific egress window or size of egress window, the window fits properly within the opening without requiring time consuming custom fitment.

Referring to FIGS. 2 & 3, in some embodiments and variations a sealant tape 16 is applied to the planar inside surface of the flange portion 14 fully circumscribing the center open portion 11. The tape is typically ½" to 1" wide and comprised of a tacky natural or synthetic elastomeric compound. It is preferably 0.125-0.50" thick and more preferably about 0.25"-0.38" thick. The tape is similar to the tape used to secure windshields in an automobile. When adhered to the inside surface of the flange portion, a layer of release paper or sheet is left over the tape's exterior surface to protect it from dirt and debris. Just before sliding the frame in place the release material is removed. The tape sticks and bonds to the exterior surface of the foundation wall. When the structural frame 10 is secured and compressed against the wall through the installation of the concrete pins 20, the sealant tap compresses, deforms and flows to form a watertight seal against the foundation wall filling in any imperfections and texture on the wall. In other variations, caulk or other type of sealant can be used as an alternative sealing means.

In older homes, 30.5" wide by 20" high window units were a semi-standard size for many years. Accordingly, if the left and right sides of the original window's window buck is to be left in place, the distance between the outer surfaces of the left and right second legs should be slightly less than 30.5" for retrofitting this size window. When the thickness of second legs are considered, the width of the center open portion is about 30.0", which is sufficient to fit a 29.5" widow egress window unit. Stated another way, the replacement window will be about 97% the width of the original window. However, the height of the new window is limited only by the size of the foundation wall and the available structural frames. For the foregoing original window size, typically a window unit having about a 47" height is specified.

Figure 11:
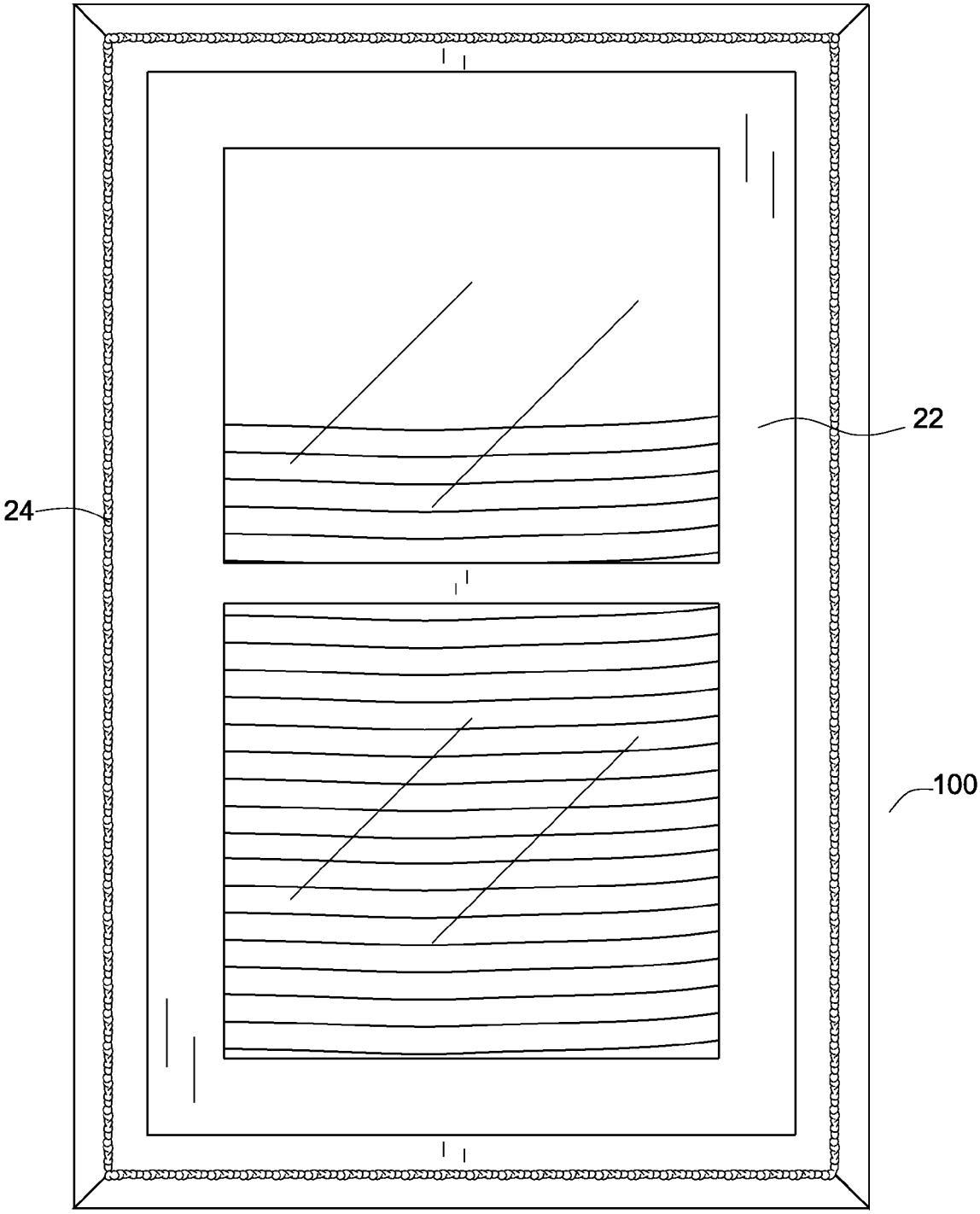
FIG. 11 is an interior isometric view of the basement wall of FIG. 4 after the egress window has been installed according to one embodiment of the present invention.
Figure 12:
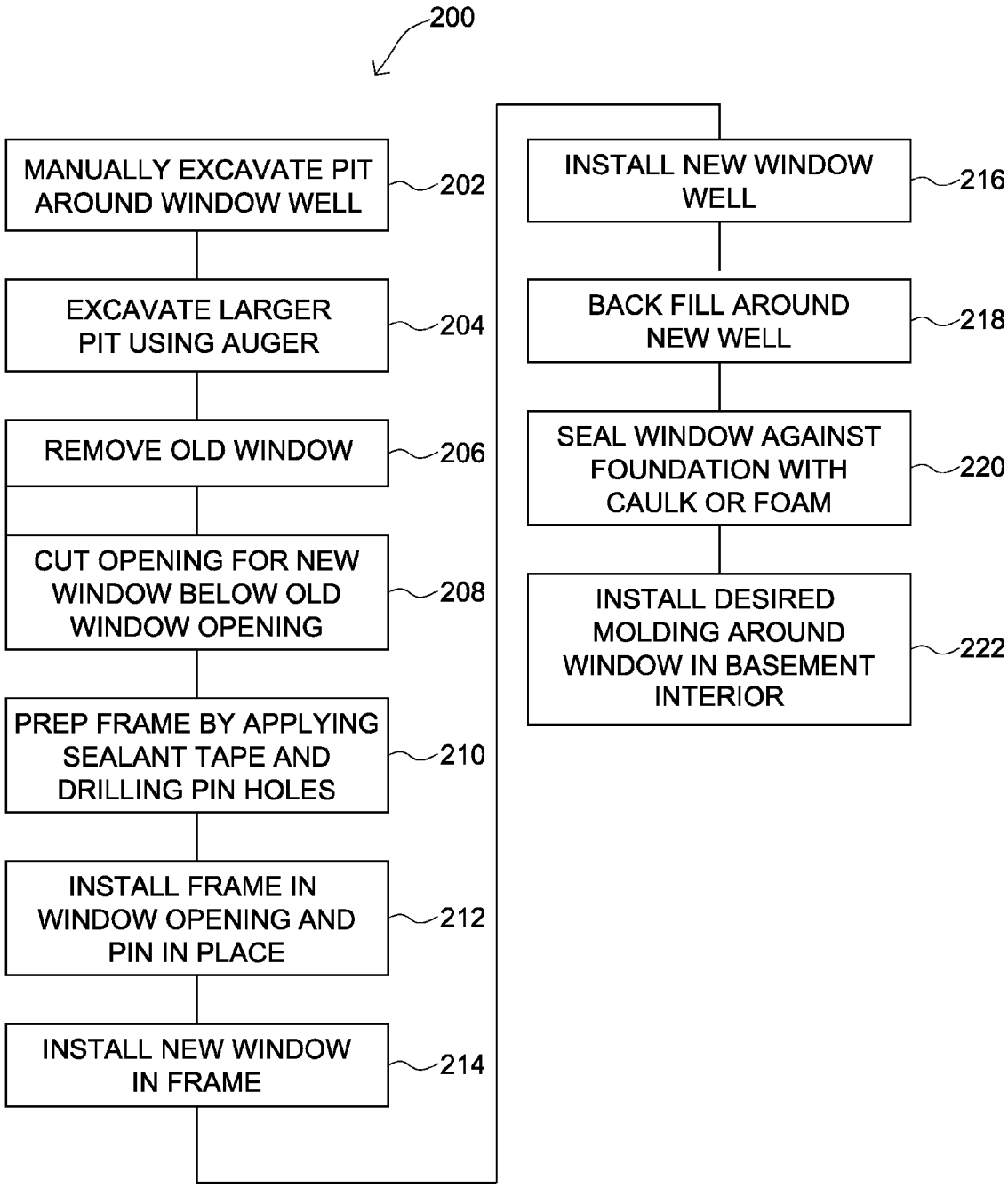
FIG. 12 is a flow chart indicating the process of retrofitting a basement with an egress window according to one embodiment of the present invention.

A Method of Retrofitting an Egress Window into a Preexisting Basement Foundation using a Structural Frame With reference to the flow diagram of FIG. 12 and the illustrations of FIGS. 4-11, a method of retrofitting an egress window in place or an original basement window is described herein.

Figure 4:
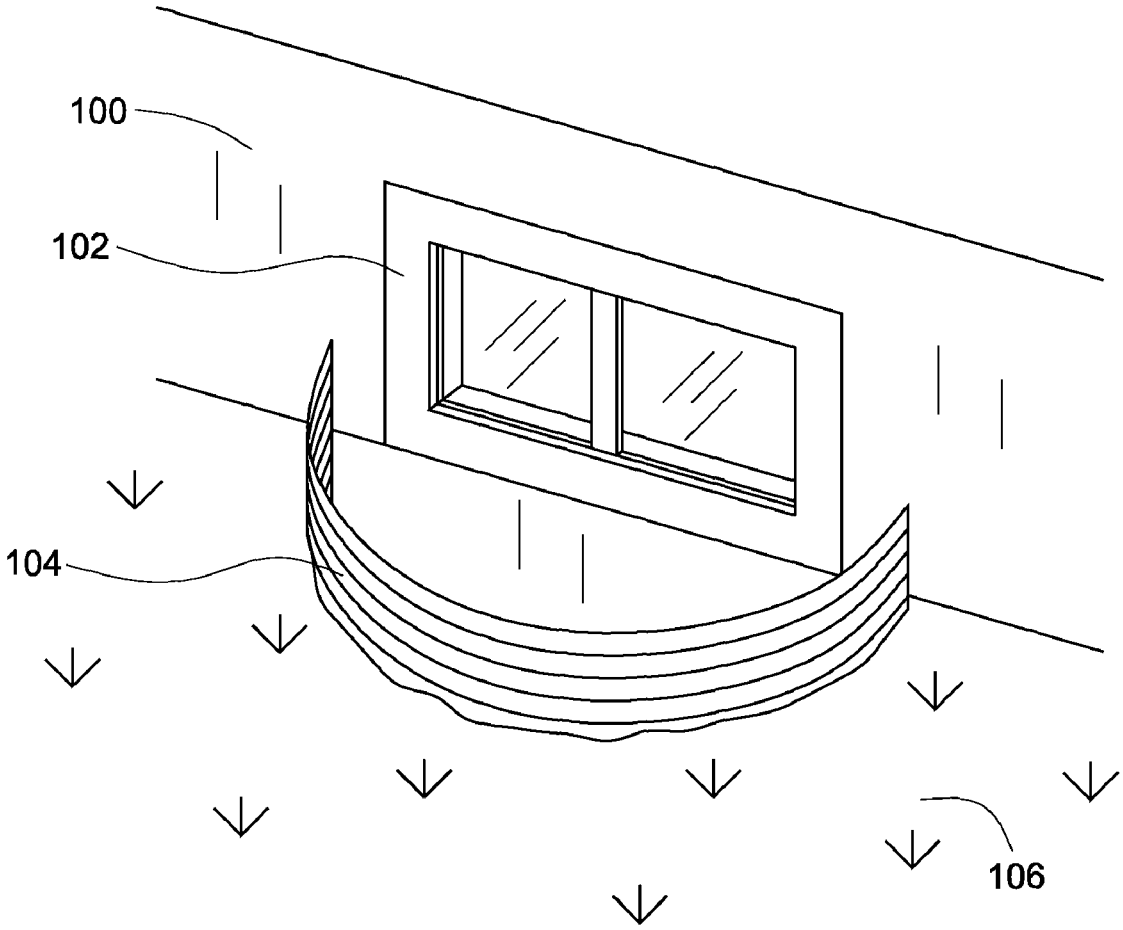
FIG. 4 is an isometric view looking down on a typical basement window and surrounding basement wall found in many older homes prior to retrofitting with an egress window.

FIG. 4 is an isometric view of a typical basement window 102 as is found on many older homes. The window is usually small with about 30.5" wide by 20" tall being very common. It is most often located near the top of a basement wall 100 such that it is difficult for someone of average height to look out of the window from the basement interior without looking up. More significantly it is too small and located too high to permit a person egress through the window as might be necessary when a fire has blocked the stairs to the basement. Since the bottom of the window is often below grade level of the ground 106, a window well 104 is provided.

Figure 5:
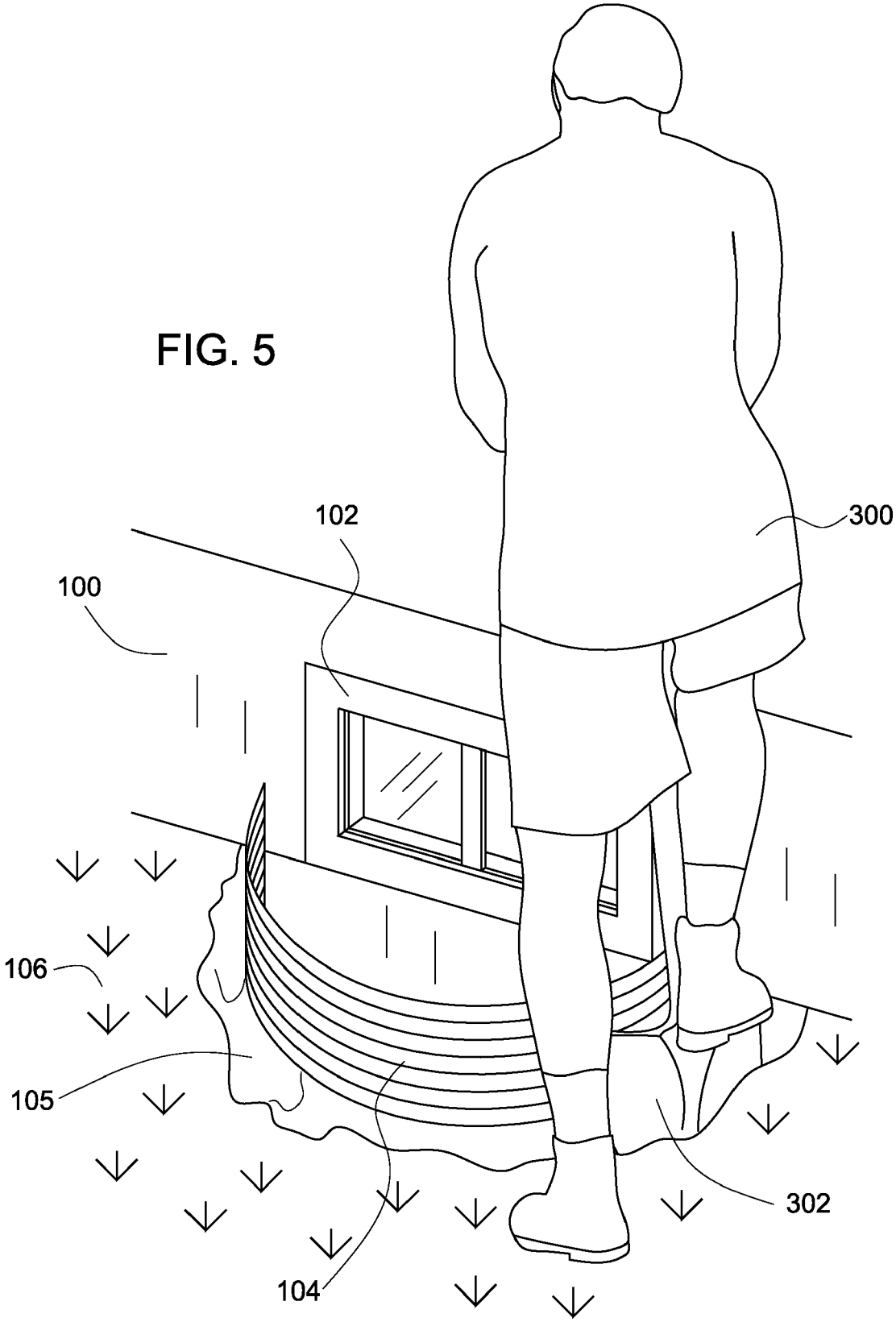
FIG. 5 is an exterior isometric view of the basement window and surroundings of FIG. 4 wherein the area immediately adjacent the associated window well is being excavated manually to form a trench according to one embodiment of the present invention.

To begin the process of retrofitting the original window with a larger one, the ground surrounding the window must be excavated to provide installers access to the foundation wall as well as provide space for a larger window well after the job has been completed. Traditionally, using prior art methodologies a backhoe or other equally destructive equipment is used for the excavation process. As can be appreciated, a backhoe can cause substantial damage to the grass and landscaping surrounding the window to be replaced. To minimize any incidental damage, the area immediately outside of the window well 104 is excavated by a installer 300 using a shovel 302 or other implement to form a trench 105 around and to the outside of the window well as is indicated in block 202 of FIG. 12 and as is illustrated in FIG. 5.

Figure 6:
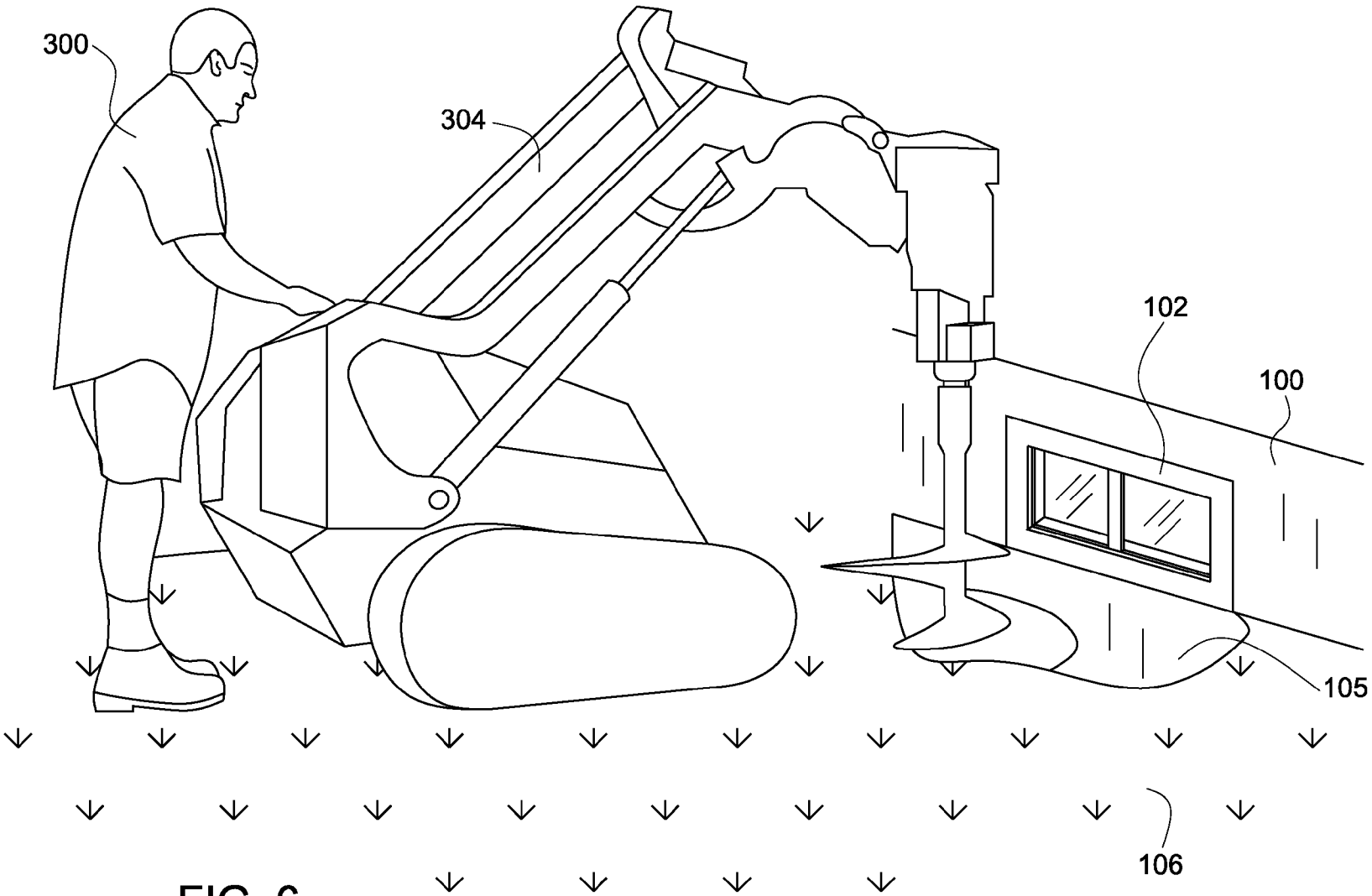
FIG. 6 is an exterior isometric view of the basement window of FIGS. 4 & 5 showing the excavation of the ground surrounding the window with a power auger according to one embodiment of the present invention.

The trench 105 provides an initial guide for power auger 304 that is then utilized to further excavate a pit surrounding the window as shown in FIG. 6 and indicated in block 204 of FIG. 12. By using an auger, a pit can be excavated that has substantially vertical sidewalls and thereby minimizing impact to the ground immediately surrounding the window. At some point during the excavation, the old window well 104 can be removed. A large enough pit must be excavated to allow an installer to cut and remove the necessary portion of the foundation wall immediately below the original window 102.

Figure 8:
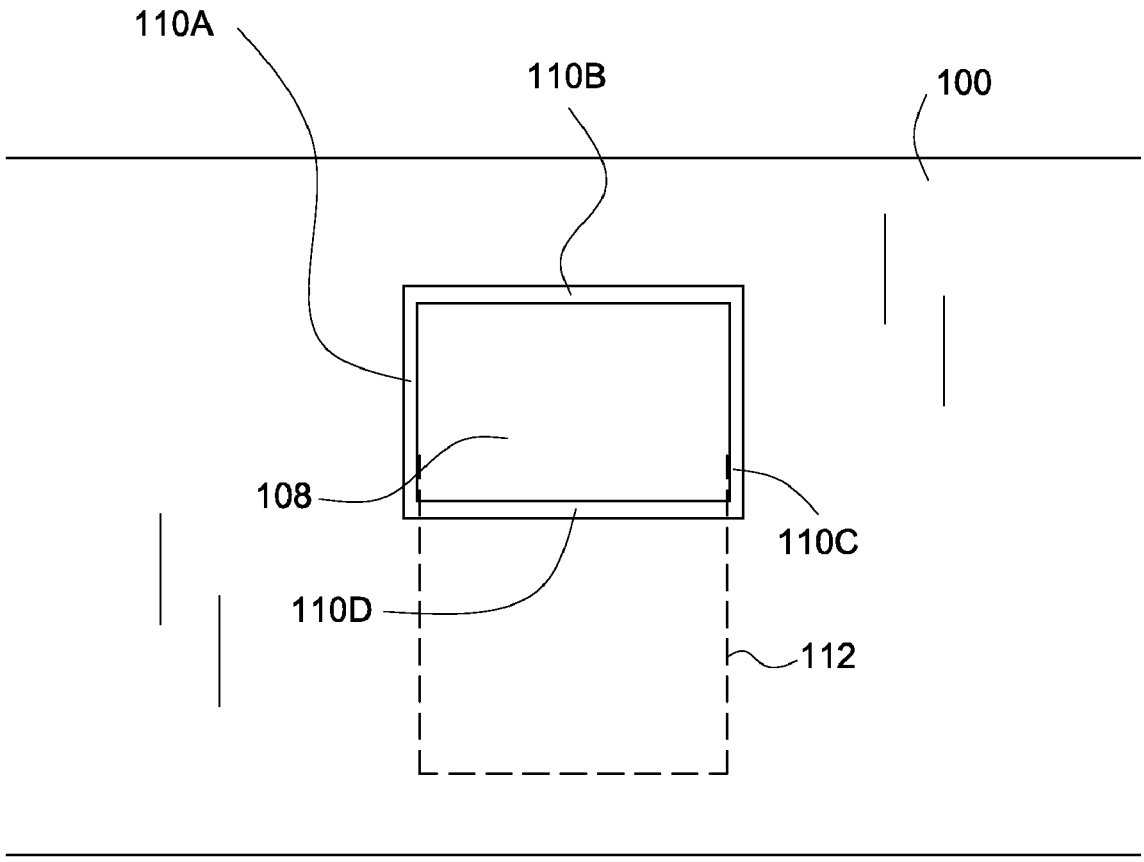
FIG. 8 is an exterior view of the basement wall shown of FIG. 4 with the cuts to be made with the ring saw indicated in dashed lines according to one embodiment of the present invention.

Next, as indicated in block 206, the original window 102 is removed from its window buck 110 and appropriately discarded. As shown in FIG. 8, the locations of the cuts 112 to be made to the foundation wall are determined and laid out. Generally, a horizontal cut is made first at the bottom edge of the desired opening. The vertical side cuts are then made extending from just inside of the vertical sides 110A&C of the window buck 110 to an intersection with the horizontal cut. Of particular note, is that the installer cuts through the bottom side 110D of the window buck but leaves the left right and top sides 110A-C of the buck in place.

Figure 7:
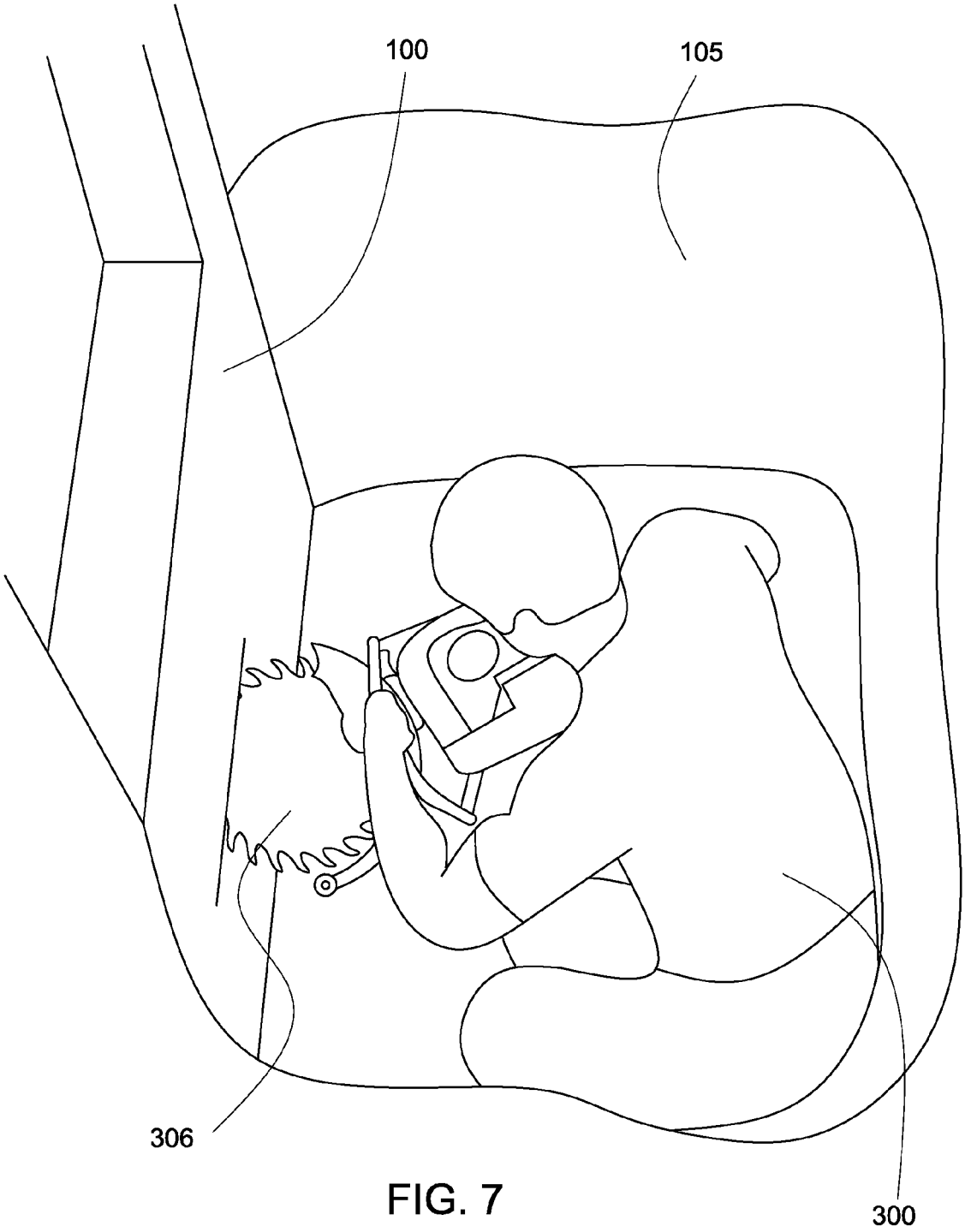
FIG. 7 is an exterior isometric view of the basement wall after the window shown in FIG. 4 has been removed also illustrating a person enlarging the opening for the egress window using a ring saw according to one embodiment of the present invention.

FIG. 7 is an illustration showing an installer 300 making the aforementioned cuts using the rings saw 306 as is also indicated in block 208 of FIG. 12. By properly laying out the location of the cuts and using a precision instrument, such as an arborless ring saw, a skilled installer can make the cuts to within plus or minus an eighth of an inch of their desired location. These high tolerances permit subsequent and proper fitment of the structural frame 10. Generally, it is considered desirable to make the foundation cuts from the outside of the basement to minimize the introduction of dirt and debris inside the residence; however, the cuts can also be made from the interior of the basement.

As indicated in block 210 of FIG. 12, the structural frame 10 is prepped for installation by applying sealant tape 16 to the back surface of the flange portion. The tape acts to seal the perimeter of the frame against the exterior surface of the foundation wall 100 and prevent water intrusion. Additionally, the plurality of mounting holes 18 are drilled through the exterior flange portion 14 to receive concrete pins 20 therein.

As indicated in block 212, the prepped frame 10 is lowered into the pit 105 and the insertion portion 12 is inserted into the opening until the sealant tape 16 is flush in contact with the exterior surface of the foundation wall 100. As necessary, the frame is shimmed to ensure it is square and level within the opening; however, because of the precise nature of the cutting operation minimal adjustment is typically required.

Pilot holes are then drilled into the foundation wall using the plurality of flange holes 18 as guides. Next, concrete pins 20 are inserted into the holes and secured in place. Typically, the pins must be pounded in place, such as with a sledge hammer. The resultant pressure pulls the flange portion 14 towards the foundation wall 100 and causes the sealant tape 16 to flow and deform to ensure a water tight seal therewith. In some circumstances, such as with brick foundations, the frame is bolted to the foundation wall instead of being pinned. In these circumstances, a fastener hole is drilled all the way through the foundation, the bolt is placed into the frame and through the foundation and it is secured in place with a threaded nut on the inside of the wall. Concerning brick foundations, it is or worthy note that the portion of the retrofitted wall containing the structural frame 10 is often stronger than the section of the wall that is replaced. Accordingly, an egress window can be fit into brick foundations even when the integrity of the brick stem wall is beginning to show signs of deterioration.

Figure 9:
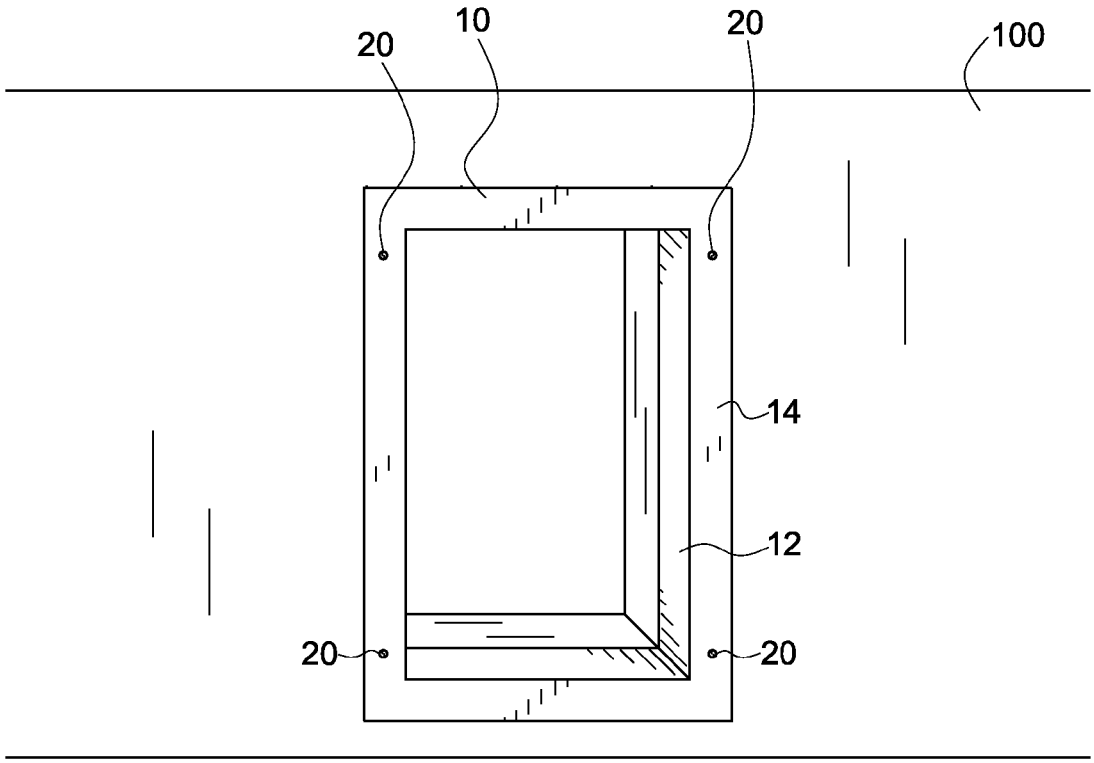
FIG. 9 is an exterior isometric view of the basement wall of FIG. 4 after the cut portion has been removed and the structural frame has been installed into the opening according to one embodiment of the present invention.
Figure 10:
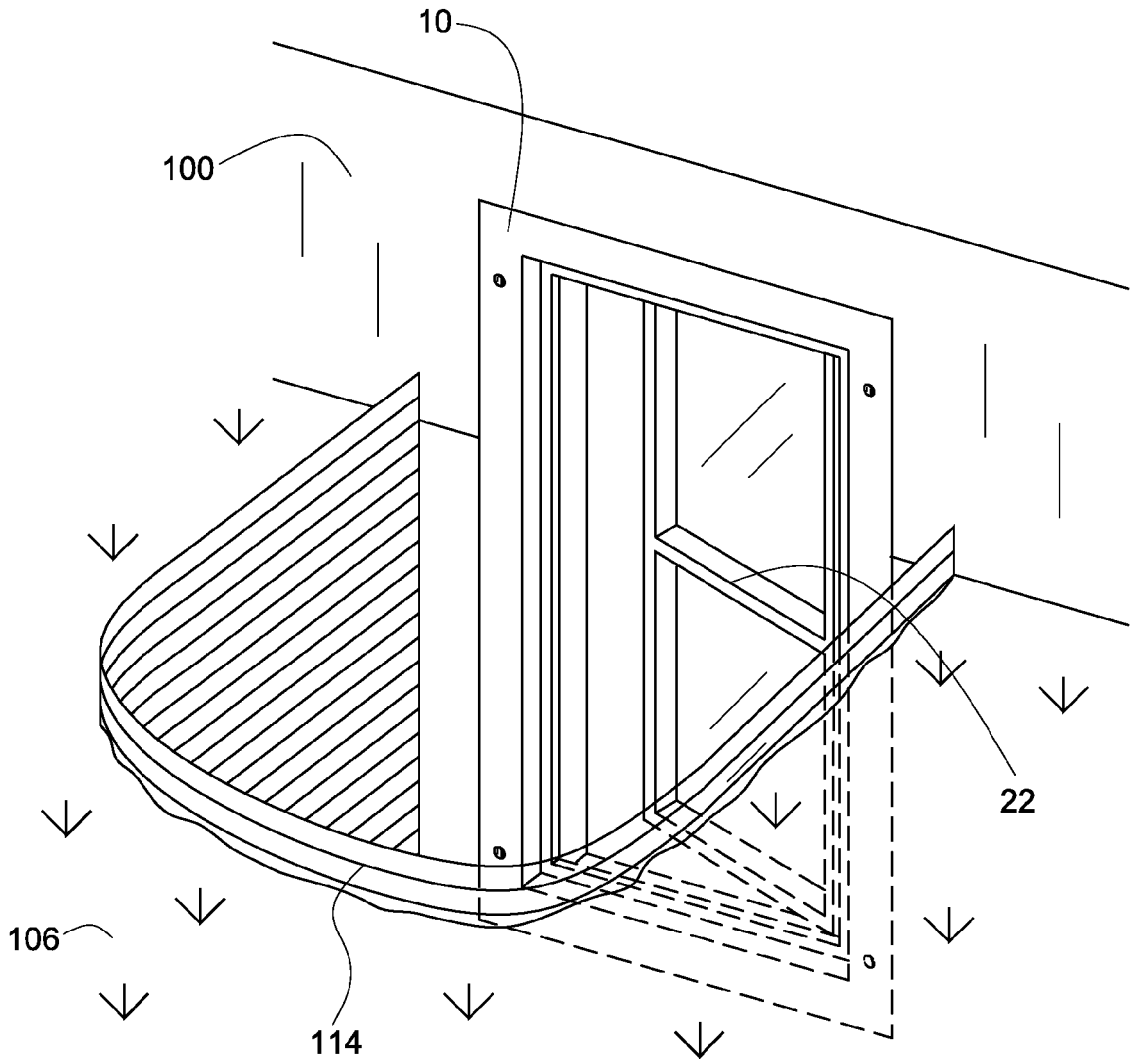
FIG. 10 is an exterior isometric view of the basement wall of FIG. 4 with a new egress window installed therein according to one embodiment of the present invention.

FIG. 9 is an exterior illustration of an installed structural frame 10 viewed from the exterior. The frame is pinned in place with four concrete pins 20. In instances wherein the foundation is of the piered-type, several additional pins are typically provided along the flanged portion 14 on the bottom side thereof to more effectively transfer load from the foundation wall 100 to and through the frame. As can be seen in the figure, the insertion portion 12 extends into the opening about four inches or so depending on the size of the L-channel comprising the frame. Since the typical foundation wall is much thicker than the frame it extends rearwardly beyond the rearmost edge of the insertion portion. No further finishing of the exterior wall and installed frame is required. Since the frame is painted prior to installation, such as with a rust resistant primer, it is generally resistant to rust. However, the frame can be painted to compliment the color of the building as desired.

As indicated in block 214, the egress window is fit within the frame and secured in place. Typically, the window 22 will overhang the rearmost edge of the sides of the insertion portion forming a small gap. The window is squared and plumbed as necessary and fixed to the perimeter of the foundation wall opening. The gap is filled with caulk 24 or spray foam as is necessary to seal and insulate the window as is indicated in block 220. An interior view of the window prior to the installation of finish molding is shown in FIG. 11.

On the exterior of the building a new larger egress capable window well 114 is installed to the foundation and the remainder of the pit surrounding exterior of the well is back filled and graded as necessary as is indicated in blocks 216 & 218.

Finally, as desired, molding is installed around the window in the interior of the basement using known procedures and materials as is indicated in block 222.

With a crew of two or three installers, the time required to retrofit an egress window in a basement foundation wall is typically 6-12 hours. This compares favorably to prior art methodologies which typically require two or more days.

Other Embodiments and Variations

The various preferred embodiments and variations thereof illustrated in the accompanying figures and/or described above are merely exemplary and are not meant to limit the scope of the invention. It is to be appreciated that numerous variations to the invention have been contemplated as would be obvious to one of ordinary skill in the art with the benefit of this disclosure. All variations of the invention that read upon the appended claims are intended and contemplated to be within the scope of the invention.

For instance, the described embodiments all pertain to the installation of an egress window. However, it is to be appreciated that a suitably sized structural frame and the process described herein can be used to install (i) doors within a foundation; and (ii) non-egress type windows, such as fixed pane windows or windows not meeting egress requirements.

I claim:

1. A method of retrofitting a first basement window in a building with a second window wherein the second window has a greater surface area than the first window, the method comprising:

removing a smaller first window from a opening in a foundation wall while leaving a window buck in place;

enlarging the opening by cuffing out a bottom side of the window buck and a portion of the foundation below the opening to create a larger opening but leaving a top side and at least substantial portions of the left and right sides of the window buck in place;

installing a structural frame in and around the larger opening, the structural frame comprising L-channel and having left, right, top and bottom sides, a first leg of the L-channel of each side forming collectively forming a flange portion with the other sides, the flange portion having a substantially planar back surface, the second leg of the L-channel of each side extending orthogonally away from an inside edge of the first leg; and installing a larger second window in the larger opening.

2. The method of claim 1 further comprising:

before said enlarging the opening, excavating a pit in the ground abutting the opening using a power auger.

3. The method of claim 2 further comprising:

before said excavating an pit, manually digging a channel abutting a first window well, the width of the channel being at least the diameter of an auger blade of the power auger.

4. The method of claim 1 wherein the structural frame includes a plurality of holes extending through the flange portion, the method further comprising:

drilling fastener holes into the foundation using the plurality of holes as guides; and installing concrete pins through the plurality of holes and into the corresponding fastener holes.

5. The method of claim 1 further comprising:

installing a new window well of a sufficient size to permit a person egress therethrough; and backfilling the remainder of the pit on an exterior of the new window well.

6. The method of claim 1 further comprising:

after installing a larger second window, sealing the second window against the foundation using one or both of caulk and expanding foam.

7. The method of claim 6 further comprising:

after said sealing the second window, trimming the window from the interior of basement.

8. The method of claim 5 further comprising:

painting the structural frame a color complimentary with the color of the building.

9. The method of claim 1 further comprising completing the job in 10 hours or less.

10. The method of claim 1 wherein the structural frame includes a plurality of holes extending through the flange portion, the method further comprising:

drilling fastener holes into the foundation using the plurality of holes as guides; and bolting the structural frame to the foundation wall using the plurality of holes and the corresponding fastener holes.

11. The method of claim 1, wherein no additional reinforcement other than the structural frame and the window buck is utilized to provide structural support for the window and the foundation.

12. The method of claim 1 wherein said enlarging the opening is performed using a ring saw.

13. A method of retrofitting a first basement window in a building with a second window wherein the second window has a greater surface area than the first window, the method comprising:

removing a smaller first window from a opening in a foundation wall while leaving a window buck in place;

enlarging the opening by cutting out a bottom side of the window buck and a portion of the foundation below the opening to create a larger opening but leaving a top side and at least substantial portions of the left and right sides of the window buck in place;

sliding a structural frame in and around the larger opening from an exterior of the foundation wall, the structural frame comprising L-channel and having left, right, top and bottom sides, a first leg of the L-channel of each side forming collectively forming a flange portion with the other sides, the flange portion having a substantially planar back surface, the second leg of the L-channel of each side extending orthogonally away from an inside edge of the first leg, the structural frame having sealant tape adhered to the planar back surface;

drilling fastener holes into the foundation using the plurality of holes as guides;

securing the frame to the foundation by installing concrete pins through the plurality of holes and into the corresponding fastener holes; and installing a larger second window in the larger opening.

14. The method of claim 13, wherein no additional reinforcement other than the structural frame and the window buck is utilized to provide structural support for the window and the foundation.

* * * * *